US009255470B2

(12) United States Patent
Marmorshteyn et al.

(10) Patent No.: US 9,255,470 B2
(45) Date of Patent: Feb. 9, 2016

(54) METHOD OF INCREASING PRODUCTIVITY OF OIL, GAS AND WATER WELLS

(71) Applicants: Leon Marmorshteyn, Foster City, CA (US); Peter Mouler, Irvine, CA (US)

(72) Inventors: Leon Marmorshteyn, Foster City, CA (US); Peter Mouler, Irvine, CA (US)

(73) Assignee: ARGOSY TECHNOLOGIES, Palm Desert, CA (US)

( * ) Notice: Subject to any disclaimer, the term of this patent is extended or adjusted under 35 U.S.C. 154(b) by 0 days.

(21) Appl. No.: 14/591,201

(22) Filed: Jan. 7, 2015

(65) Prior Publication Data

US 2015/0218926 A1 Aug. 6, 2015

Related U.S. Application Data

(63) Continuation of application No. 13/545,191, filed on Jul. 10, 2012, now Pat. No. 9,045,978.

(51) Int. Cl.

| | |
|---|---|
| ***E21B 7/04*** | (2006.01) |
| ***E21B 43/26*** | (2006.01) |
| ***E21B 43/30*** | (2006.01) |

(52) U.S. Cl.

CPC ..... *E21B 43/26* (2013.01); *E21B 43/305* (2013.01)

(58) Field of Classification Search

CPC ..... E21B 7/04; E21B 7/046; E21B 43/26; E21B 43/305; E21B 49/006

See application file for complete search history.

(56) References Cited

U.S. PATENT DOCUMENTS

| | | | | |
|---|---|---|---|---|
| 4,706,751 | A * | 11/1987 | Gondouin | 166/401 |
| 8,025,101 | B2 * | 9/2011 | Hansen et al. | 166/272.2 |
| 2003/0158669 | A1 * | 8/2003 | Davidson | 702/18 |

* cited by examiner

*Primary Examiner* — Catherine Loikith
(74) *Attorney, Agent, or Firm* — Henry M. Feiereisen LLC.

(57) ABSTRACT

For increasing productivity of oil, gas and water wells, a horizontal or inclined well is excavated, a plurality of cavities are formed transversely to the direction of elongation of the well so as to provide partitions between them, and hydrocracking is carried out to act on the partitions between the cavities.

3 Claims, 5 Drawing Sheets

METHOD OF INCREASING PRODUCTIVITY OF OIL, GAS AND WATER WELLS

CROSS-REFERENCE TO A RELATED APPLICATION

This application is a continuation of earlier patent application Ser. No. 13/545,191 filed on Jul. 10, 2012, it incorporates the said earlier application in its entirety by reference thereto, and it claims priority from the said earlier application under 37 CFR 119 (a)-(d).

BACKGROUND OF THE INVENTION

The present invention relates to a method of increasing productivity of oil, gas and water wells.

Horizontal and inclined wells are usually directed along the extension of formations (strata) without taking into consideration the influence of rock pressure. This can lead to significant reduction of fluid flows, such as oil, gas and water flows, as disclosed in (1-10) of the list of sources. In addition it does not provide a complete embrace of the formation, and in condition of great depths due to compressing ring-shaped stresses as in vertical well it is not always guaranteed that it will be possible to obtain the desired product, as disclosed in (27) of the list of sources below. In these cases it is known to use hydrocracking of formation, chemical treatment and various methods of intensification, as disclosed in (1, 6, 9, 11, 12, 4, 13, 14, 15, 9, 16, 5, 17, etc) of the list of sources below. In many cases the efficiency of these methods is insufficient and their realization is very expensive. The hydrocracking, chemical treatment, point perforation connect with a well bore only a part of formation, for a short time, since the produced spaces are retained under the same rock pressure and after a certain time close again. The utilized methods of intensification do not cover the whole working distance, they are expensive, and their effect disappears after a certain time.

The known intensification methods include the method of unloading with slots, as disclosed in (19) of the list of sources below, which almost fully and permanently removes rock pressure from near-well zone. This increases efficiency of operation of the wells. However this method is not always efficient in horizontal and inclined well where a different mechanism of rock compression takes places, in which orientation of directions of perforation relative to main horizontal stresses, as well as a length and width of the cavities are important. In inclined wells it is known to carry out perforation by the method of slot unloading in a direction of maximum cracking of the near-well zone, as disclosed in (20) of the list of sources, upwards from the well, which is also not efficient, for example due to "clamping" of the cracks by ring-shaped tangential stresses of double concentration, produced around the perforation channels.

While maximum unloading of a well by a perforation takes place if a plane of a slot is oriented perpendicular to a main stress, the direction of the well is not coordinated with the main stress direction, and the unloading of the well bore will not be optimal. When the plane of the slot is close to maximum horizontal stress, the slot will not work at all and will be immediately compressed by the rock pressure. In the case of a random proper orientation of the perforation, the flow of fluid takes place only at the locations of the perforation (slots, cavities), but not along the whole length of the horizontal or inclined well.

SUMMARY OF THE INVENTION

Accordingly, it is an object of the present invention to provide a method of increasing productivity of oil, gas and water wells, which is a further improvement of the existing methods.

In keeping with these objects and with others which will become apparent hereinafter, one feature of the present invention resides, briefly stated, in a method of increasing productivity of oil, gas or water wells, comprising the steps of excavating of a horizontal or inclined well, forming in the horizontal or inclined well a plurality of cavities which extend transversely to the direction of elongation of the horizontal or inclined well and are spaced from one another in a direction of elongation of the horizontal or inclined well so as to form a plurality of partitions therebetween, providing packing of the cavities between the partitions so as to separate the cavities from the horizontal or inclined well, and executing hydrocracking by acting onto the partitions located between the cavities inside the horizontal or inclined well.

Another feature of the present invention resides in that the method includes making the cavities as slot-shaped cavities which redistribute stresses in the rock so that a concentration of stresses around the horizontal or inclined wall is substantially removed and directed to edges of the slot-shaped cavities and an unloading corridor if formed in a direction of the slot-shaped cavity. The slot-shaped cavities can be made so that the partitions between them have a length l corresponding to the following equation:

$$l = k\left[12.5 + 3\left(\frac{\sigma^1}{\sigma^2}\right)\frac{2}{3}\right], d(\text{cm})$$

where $\sigma^1$ is a max horizontal stress at location of perforation, MPa, $\sigma^3$ is a strength of productive formation in near-well zone, MPa, d is a diameter of well (cm), k=0.5-5.0 depending on geological conditions.

A further feature of the present invention resides in the method includes making the cavities as disc-shaped cavities which redistribute stresses in the rock so that a concentration of stresses around the horizontal or inclined wall is substantially removed and directed to edges of the disc-shaped cavities and an unloading corridor if formed in a direction of the disc-shaped cavity. The disc-shaped cavities can be made so that the partitions between them have a length l corresponding to the following equation.

$$l = k\left[10 + 2\left(\frac{\sigma^1}{\sigma^2}\right)\frac{2}{3}\right], d(\text{cm})$$

where $\sigma^1$ is a max horizontal stress at location of perforation, MPa, $\sigma^3$ is a strength of productive formation in near-well zone, MPa, d is a diameter of well (cm), k=0.5-5.0 depending on geological conditions.

When the method of increasing productivity of oil, gas and water wells is performed in accordance with the present invention it eliminates the disadvantages of the prior art and achieves the above-mentioned highly advantageous results.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
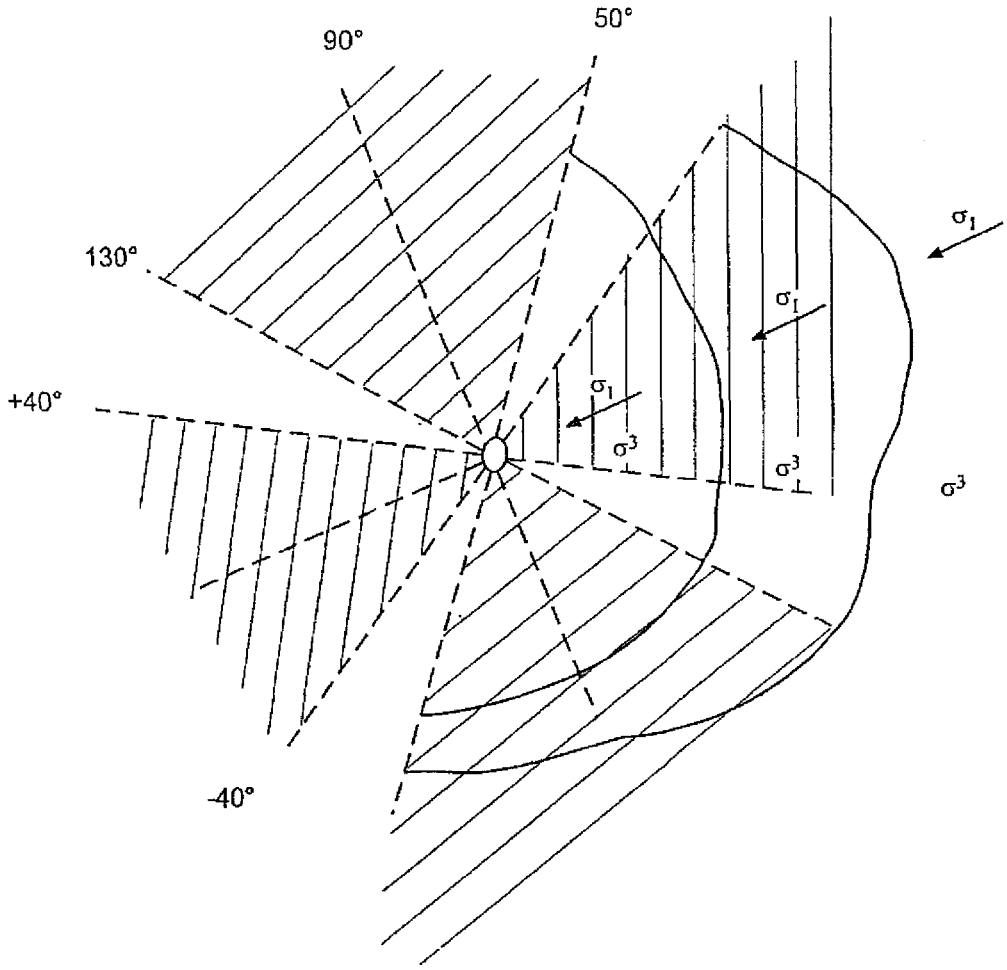
FIG. 1 of the drawings is a view showing a selection of a direction of making a horizontal or inclined well in accordance with the present invention, FIG. 2 of the drawings is a view showing a horizontal or inclined well with disc-shaped cavities in accordance with the present invention, FIG. 3 of the drawings is a view showing a horizontal or inclined well with vertical slot-shaped cavities in accordance with the present invention, FIGS. 4*a* and 4*b* of the drawings are views showing incorrect and correct orientation vertical slot-shaped cavities, correspondingly, in accordance with the present invention, FIGS. 5*a* and 5*b* of the drawings are views showing the selection of sizes and arrangement of the disc-shaped cavities and stress distribution, correspondingly, in accordance with the present invention, FIGS. 6*a* and 6*b* of the drawings are views showing the selection of sizes and arrangement of the vertical slot-shaped cavities and stress distribution, correspondingly, in accordance with the present invention.

In accordance with the present invention first a vertical well 2 extending to a productive formation is made. At the location of the vertical well a vector (direction and value) of a maximum horizontal stress of rock $\sigma^1$ is determined by known means. Then a direction for a horizontal or inclined well 3 extending from the vertical well 2 is selected. In accordance with the present invention best results are obtained when the direction of a horizontal or inclined well is selected to be as close as possible along or transverse to the main maximum stress. It is acceptable to produce the horizontal or inclined well in a direction which deviates from the main maximum stress direction by 40 degrees at both sides of it, or in other words ±40° as shown in FIG. 1. Based on this concept, the horizontal or inclined well is made in a known manner, for example as disclosed in (23) of the list of sources below.

Figure 2:
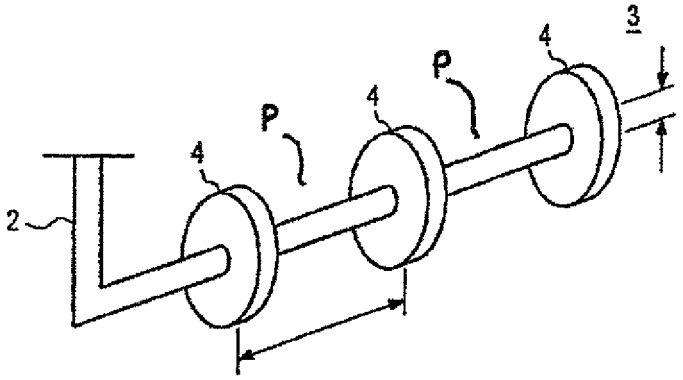
Figure 3:
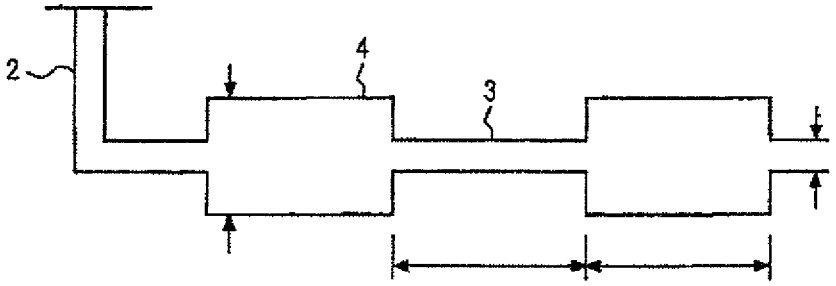

The horizontal or inclined well oriented along the main maximum horizontal stress is shown in FIG. 2, while the horizontal or inclined well oriented transverse to the main maximum horizontal stress is shown in FIG. 3. When the horizontal or inclined well is made in this manner, then slots cavities 4 are made. These cavities can be produced by a sand-blasting perforator, for example AP-6, as disclosed in (24) of the list of sources below. The sand-blasting provides ideal opening of the formation, does not damage cement or casing, and establishes an ideal communication between the well and rock of the formation.

The reduction of excessive (when compared with normal geostatic) stresses acting near the well leads to a possibility to increase permeability of productive formation and increase in flow of fluid to the well. The formation of the slots or cavities 4 causes redistribution of stresses. Concentration of stresses around the well is redistributed to the edges of the slots or cavities, and a corridor of unloading is formed in direction of the slot or cavity. The combination of the above mentioned selection of the direction of making the horizontal or inclined well relative to horizontal stresses with the orientation of the slot-shaped cavities increases the productivity of the well along its whole length and for a long time.

Since the horizontal or inclined well has a great length, cutting of continuous longitudinal slots is expensive and complicated. In the present invention the cavities are made to be spaced with one another and to leave a plurality of partitions P therebetween. The partitions P contribute to inflow of fluid and have sizes selected in a new inventive way. The cavities can be disc-shaped as shown in FIG. 2 or vertical slot-shaped as shown in FIG. 3, and the distances between them are different. It is necessary that the partitions P between them stay not destroyed or in other words withstand the loads acting on them so they act as stamps onto the surrounding rock, and in this case the fluid is pressed from the productive formation into the cavities and into the well. The length of the partition P must be not greater than double width of the zone of pressure formed from each of neighboring adjacent cavities.

For the partitions between the disc-shaped cavities the length of the partitions in the inventive method is selected as:

$$l = k\left[10 + 2\left(\frac{\sigma^1}{\sigma^2}\right)\frac{2}{3}\right],\ d(\text{cm})$$

$\sigma^1$ is a max horizontal stress at location of perforation, MPa, $\sigma^3$ is a strength of productive formation in near-well zone, MPa, d is a diameter of well (cm), k=0.5-5.0 depending on geological conditions.

For the partitions between the vertical slot-shaped cavities the length of the partition in the inventive method as selected as:

$$l = k\left[12.5 + 3\left(\frac{\sigma^1}{\sigma^2}\right)\frac{2}{3}\right],\ d(\text{cm})$$

where $\sigma^1$ is a max horizontal stress at location of perforation, MPa, $\sigma^3$ is a strength of productive formation in near-well zone, MPa, d is a diameter of well (cm), k=0.5-5.0 depending on geological conditions.

Figure 4A:
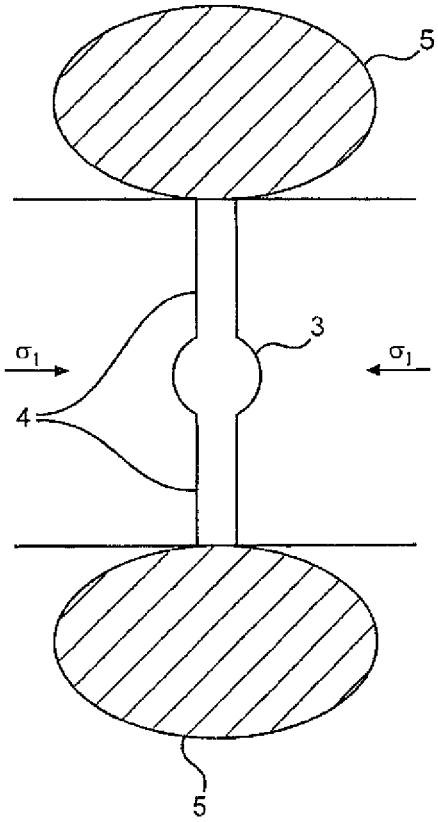
Figure 4B:
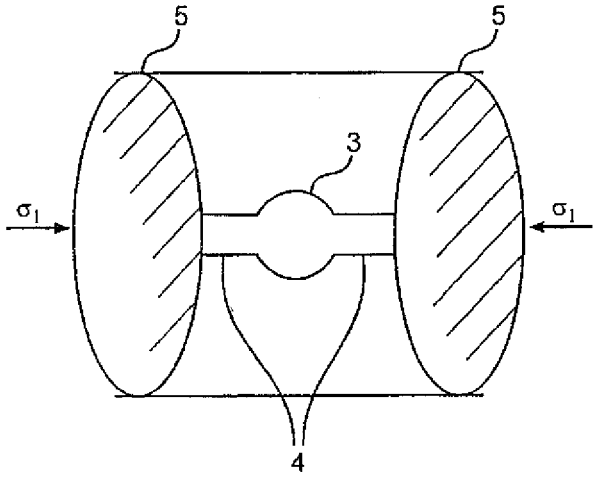
Figure 5A:
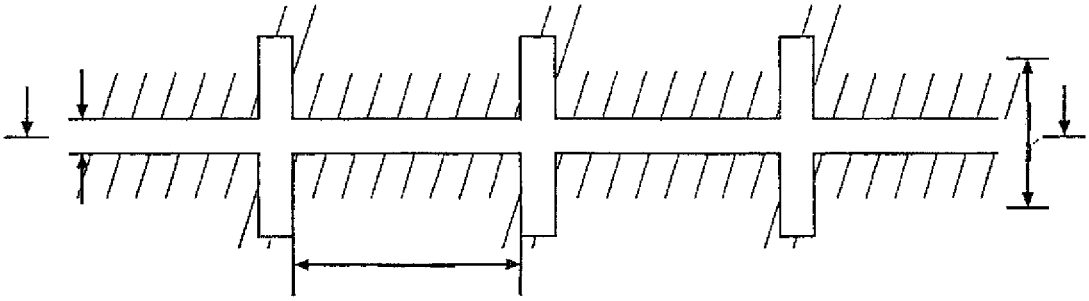
Figure 5B:
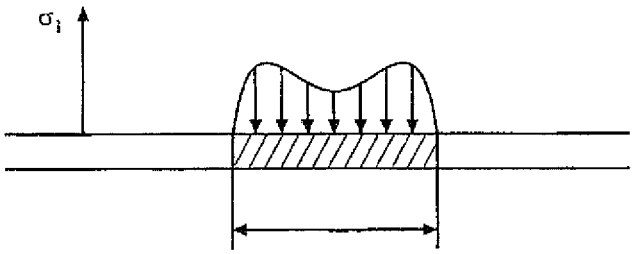
Figure 6A:
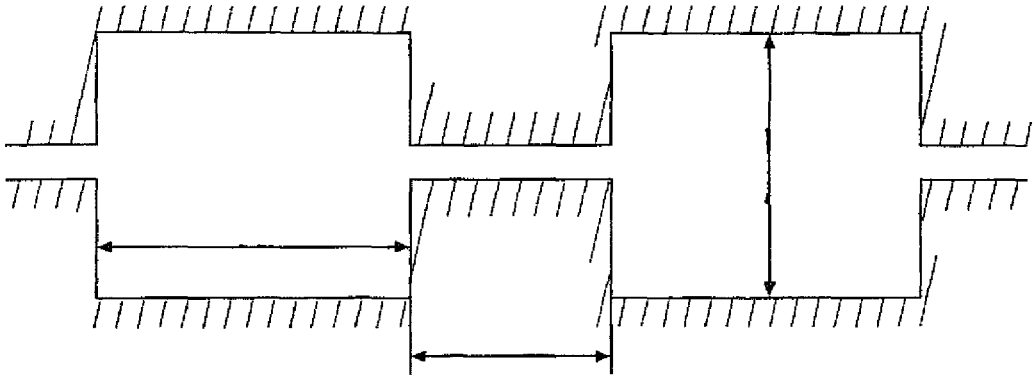
Figure 6B:
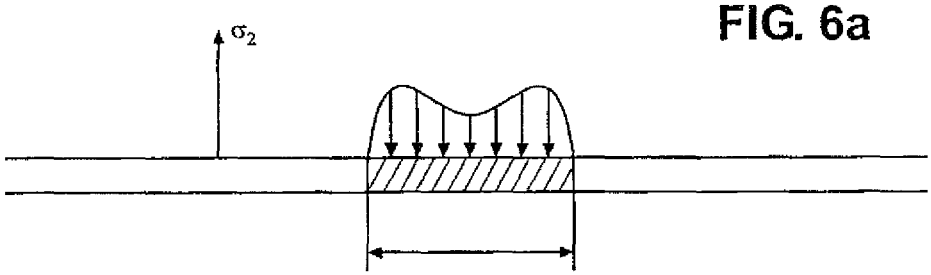

FIGS. 4*a* and 4*b* show the horizontal or inclined well, the slots or cavities 4, and zones of pressure 5, with the left illustration showing incorrect location of the slots or cavities and the right illustration showing correct location of the slots of cavities.

FIGS. 5*a*, 5*b* and 6*a*, 6*b* illustrate correspondingly the disc-shape cavities and the slot-shaped cavities with the partitions therebetween, and the distribution of the stresses in the partitions.

In accordance with the present invention, the depth and thickness of the cavities 4 is selected for their optimization. On one hand the cavities must unload the ring-shaped stresses around the horizontal or inclined well, while on the other hand their perforation is complicated and expensive. In view of the fact that the disc-shaped cavities and vertical slot-shaped cavities act in different ways, their dimensions are selected in different ways.

The disc-shaped cavities must have the depth of more than 2 well diameters and the thickness not less than 2 cm, while the vertical slot-shaped cavities must have the depth of more or equal to 2 well diameters and the thickness not less than 3 cm. A decrease of these size leads to a change in flow of fluid, while their increase leads to abnormal complexity and cost of work. In accordance with the invention, borders of the tectonically stressed zones are determined, in these zones the value of maximum main horizontal stress and the strength of the productive layer are determined, and depending on these values the dimensions of the cavities and activating partitions therebetween are determined in these zones.

After the formation of the cavities in the horizontal or inclined well and packing by packers in the horizontal or included well, hydrocracking is performed of the activated partitions successively.

The inventive method has been tested on experimental model, with the productive formation located at a depth of 1,200-1,201.5 m, well length 120 m, $(\sigma^1)$=30 MPa and $(\sigma^3)$ =60 MPa.

Table 1 shows the results.

TABLE 1

| DIRECTION OF WELL | SLOT-SHAPED CAVITIES | CHANGE OF CAVITIES IN TECTONIC STRESSED ZONES | SLOTS | YIELD A DAY |
|---|---|---|---|---|
| 1. Along max. main horizontal stress | No | No | Yes | 100-200 |
| 2. +40 from 1 | No | No | Yes | 70-120 |
| 3. −40 from 1 | No | No | Yes | 70-100 |
| 4. Transverse max horizontal stress | No | No | Yes | 200-300 |
| 5. +40 of 1 | No | No | Yes | 120-200 |
| 6. −40 of 1 | No | No | Yes | 120-150 |
| 7. As 1 | Yes | No | No | 1000-1500 |
| 8. As 1 | Yes | No | Yes | 900-1500 |
| 9. As 2 | Yes | No | Yes | 600-800 |
| 10, As 3 | Yes | No | Yes | 600-800 |
| 11. As 4 | Yes | No | Yes | 2000-2500 |
| 12. As 4 | Yes | No | No | 1700-2000 |
| 13. As 5 | Yes | No | Yes | 1200-1600 |
| 14. As 6 | Yes | No | Yes | 1100-1500 |
| 15. As 10 | Yes | No | Yes | 1100-1500 |
| 16. As 10 | Yes | Yes | Yes | 1100-1700 |

It will be understood that each of the elements described above, or two or more together, may also find a useful application in other types of methods differing from the types described above.

While the invention has been illustrated and described as embodied in a method of increasing productivity of oil, gas and water wells, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt t for various applications without omitting features that, from the standpoint of prior art, fairly constitute essential characteristics of the generic or specific aspects of this invention.

What is claimed as new and desired to be protected by Letters Patent is set forth in the appended claims.

LIST OF SOURCES

1. U.S. Pat. No. 5,074,360
2. U.S. Pat. No. 4,658,588
3. U.S. Pat. No. 4,669,546
4. U.S. Pat. No. 5,016,709
5. U.S. Pat. No. 4,388,286
6. U.S. Pat. No. 0,474,850
7. SU 1677278
8. SU 1677274
9. U.S. Pat. No. 6,842,652
10. U.S. Pat. No. 4,883,124
11. U.S. Pat. No. 435,756
12. SU 1601354
13. U.S. Pat. No. 4,696,345
14. U.S. Pat. No. 4,702,315
15. U.S. Pat. No. 467,788
16. U.S. Pat. No. 4,718,100
17. SU 1740564
18. U.S. Pat. No. 5,010,964
19. Geology Methods of Search and Investigation of Oil and Gas deposits, Express Information 8-9, 1977.
20. U.S. Pat. No. 5,074,359
21. U.S. Pat. No. 4,909,336
22. GEODYNAMIC REGIONING OF GROUND, L GROUND 1990.
23. V. A. Sidorovsky. Opening of Formations and Increase of Well Productivity, M., Ground 1978.
24. Works for Permeability Increase of Oil-Containing Formations with Slot Unloading Geology, Search and Investigation of Oil and Gas Formation Express-Information, VNIIOENG 1977.
25. Petukhov I. M. Theory of Protective Formations, M. Ground, 1976.
26. Petukhov I. M., M. Ground, 1992.
27. U.S. Pat. No. 5,337,825
28. SU2079643.

The invention claimed is:

1. A method of increasing productivity of oil, gas or water wells, comprising the steps of excavating of a horizontal or inclined well;

forming in the horizontal or inclined well a plurality of cavities which extend transversely to a direction of elongation of the horizontal or inclined well and are spaced from one another in the direction of elongation of the horizontal or inclined well so as to form a plurality of partitions therebetween;

providing packing in the horizontal or inclined well by packers; and executing hydrocracking by acting onto the partitions located between the cavities inside the horizontal or inclined well, making the cavities as slot-shaped cavities which redistribute stresses in a rock so that a concentration of stresses around the horizontal or inclined wall is substantially removed and directed to edges of the slot-shaped cavities; and forming the slot-shaped cavities so that the partitions between them have a length corresponding to the following equation:

$$l = k\left|12.5 + 3\left(\frac{\alpha^1}{\alpha^3}\right)\frac{2}{3},\ d(\text{cm})\right|$$

where $\alpha^1$, is a max horizontal stress at location of perforation, MPa, $\alpha^3$ is a strength of productive formation in near-well zone, MPa, d is a diameter of well (cm), k=0.5-5.0 depending on geological conditions.

2. The method of increasing productivity of oil, gas or water wells in claim 1, further comprising first making a vertical wall, determining a direction of a maximum horizontal stress in a rock located near the vertical well, and providing the excavating of the horizontal or inclined well from the vertical well in a direction which does not deviate from the direction of the maximum horizontal stress more than 40 degrees at each side of the direction of maximum stress.

3. The method of increasing productivity of oil, gas or water wells in claim 1, further comprising providing a depth of each of the slot-shaped cavities to be more than 2 diameters of a diameter of the horizontal or inclined well and a width not less than 2 cm.

* * * * *